208-404
C6306 OR 4,545,891

United States Patent [19]
Meyers et al.

[11] Patent Number: 4,545,891
[45] Date of Patent: Oct. 8, 1985

[54] EXTRACTION AND UPGRADING OF FOSSIL FUELS USING FUSED CAUSTIC AND ACID SOLUTIONS

[75] Inventors: Robert A. Meyers, Tarzana; Walter D. Hart, Upland, both of Calif.

[73] Assignee: TRW Inc., Redondo Beach, Calif.

[21] Appl. No.: 486,276

[22] PCT Filed: Mar. 30, 1982

[86] PCT No.: PCT/US82/00394

§ 371 Date: Mar. 10, 1983

§ 102(e) Date: Mar. 10, 1983

[87] PCT Pub. No.: WO82/03404

PCT Pub. Date: Oct. 14, 1982

[51] Int. Cl.[4] ..... C10G 1/00
[52] U.S. Cl. ..... 208/11 R; 44/15 R
[58] Field of Search ..... 208/8 R, 11 R; 44/1 SR

[56] References Cited

U.S. PATENT DOCUMENTS

| | | | |
|---|---|---|---|
| 1,703,192 | 2/1929 | Hampton | 208/11 R |
| 1,938,672 | 12/1933 | Ruthruff | 196/26 |
| 2,034,818 | 3/1936 | Loughrey | 196/24 |
| 2,162,221 | 6/1939 | Kasehagen et al. | 44/1 |
| 2,296,117 | 1/1967 | Ross et al. | 208/11 |
| 2,316,005 | 4/1943 | Lachle | 260/428 |
| 2,542,666 | 11/1970 | Simpson | 208/11 |
| 2,609,331 | 9/1952 | Cheney | 202/11 |
| 2,694,035 | 11/1954 | Smith et al. | 196/49 |
| 2,768,935 | 10/1956 | Watkins | 196/52 |
| 2,940,919 | 6/1960 | Hemminger | 208/11 |
| 2,950,245 | 8/1960 | Thomsen | 208/348 |
| 2,957,818 | 10/1960 | Fischer | 208/11 |
| 2,980,600 | 4/1961 | Kelley | 208/11 |
| 3,075,913 | 1/1963 | Scheffel et al. | 208/11 |
| 3,108,059 | 10/1963 | Greenwald | 208/11 |
| 3,166,483 | 1/1965 | Masciantonio | 202/25 |
| 3,407,003 | 10/1968 | Durie | 299/4 |
| 3,501,201 | 3/1970 | Closmann et al. | 299/4 |
| 3,510,168 | 5/1970 | Camp | 299/5 |
| 3,522,168 | 7/1970 | Bichard et al. | 208/11 |
| 3,556,982 | 1/1971 | Kaminsky et al. | 208/11 |
| 3,572,838 | 3/1971 | Templeton | 299/4 |
| 3,644,194 | 2/1972 | Keely et al. | 208/11 |
| 3,708,270 | 1/1973 | Birk et al. | 48/202 |
| 3,739,851 | 6/1973 | Beard | 166/254 |
| 3,753,594 | 8/1973 | Beard | 299/4 |
| 3,759,328 | 9/1973 | Ueber et al. | 166/303 |
| 3,759,574 | 9/1973 | Beard | 299/4 |
| 3,779,601 | 12/1973 | Beard | 299/4 |
| 3,779,722 | 12/1973 | Tatum . | |
| 3,788,978 | 1/1974 | Bearden, Jr. et al. | 208/208 M |
| 3,846,276 | 11/1974 | Walker | 208/11 |
| 3,909,213 | 9/1975 | Sanders | 44/1 R |
| 3,919,118 | 11/1975 | Robinson et al. | 423/461 |
| 3,934,935 | 1/1976 | Lambly et al. | 299/2 |
| 3,960,513 | 6/1976 | Agarwal et al. | 44/1 R |

(List continued on next page.)

OTHER PUBLICATIONS

Coal Desulfurization, R. A. Meyers, 1977, pp. 25–54, 201–209, 230–234.
"Conversion of Coal To Simple Compounds", Parker et al., Industrial & Engr. Chem., vol. 47, No. 6, Aug. 1955, pp. 1586–1592.
The Effect of Molten Caustic on Pyritic Sulphur in Bituminous Coal, Masciantonio, pp. 269–275.

*Primary Examiner*—D. E. Gantz
*Assistant Examiner*—Chung K. Pak
*Attorney, Agent, or Firm*—Benjamin DeWitt; Jeffrey G. Sheldon

[57] ABSTRACT

A crushed hydrocarbon-bearing material containing hydrocarbon and foreign mineral constituents is dispersed in fused alkali metal caustic to remove the sulfur content and release the foreign mineral matter from the hydrocarbon material for recovery and/or upgrading of the hydrocarbon content. The process permits recovery of 80–95% of the available kerogen or other hydrocarbon in a mineral matrix such as oil shale rock and conditions a solid fossil fuel such as coal, as well as the kerogen or other hydrocarbon released from the mineral matrix, for removal of substantially all remaining ash and other foreign mineral matter by subsequent washing of the hydrocarbon product in an aqueous solution of acid.

22 Claims, 2 Drawing Figures

T2031W
X2037C

EXTRACTION AND UPGRADING OF FOSSIL FUELS USING FUSED CAUSTIC AND ACID SOLUTIONS

TECHNICAL FIELD

This invention relates generally to the treatment of oil shale or coal to extract the available kerogen from the oil shale or to upgrade coal. More particularly it relates to the use of fused alkali metal caustics as the treating agent for releasing kerogen from oil shale and the upgrading of high sulfur, high ash coal; the latter calling for the additional treatment with a mineral acid.

BACKGROUND ART (A) Extraction of the Kerogen from Oil Shale

A wide range of processes involving different kinds of treatments and processing steps for extracting the kerogen trapped in oil shale have been disclosed in the patent and the technical literature. The search for ways of releasing the trapped kerogen has been extensive because there has been a long felt need to economically extract the shale oil from this plentiful source of fuel. There are basically two ways of extracting the shale oil in order to treat it. It can be done by applying the treatment while the oil shale is underground, i.e. in situ type of treatment or it can be mined and brought to a treating site.

Typically the prior art which is directed to the in situ type of treatment involves the injection of hot fluids, usually 200° C., into the oil shale beds to extract the kerogen. The hot fluids disclosed are variously steam, hot water, organic solvents, organic acids or inorganic acids.

In the case where the oil shale is mined, the usual treatment has been to retort the material distilling the volatile hydrocarbons and collecting the distillate. Such a process is described in U.S. Pat. No. 2,694,035 by Lloyd B. Smith et al. The process calls for soaking the oil shale in hydrogen containing gas at 343° C. to 399° C., the addition of small amounts (4.4–22 kgs. per 4400 kgs. of shale) of inorganic polar compounds such as water, sodium hydroxide, calcium chloride to increase the yield and/or the quality of the oil and then subjecting the mixture to the retorting step.

These known techniques suffer from a number of deficiencies such as the inability to recover at least 80 to 85% of the available kerogen bound up in the oil shale. The retort technique has been successful but the amount of shale oil that can be recovered from the available oil shale is in the range of 70% to 80% due to the conversion to gases and unusable coke that results from pyrolysis of oil bearing shale. Another significant deficiency is that the heretofore known retorting technique is uneconomical when processing oil shale that has less than 25 gallons per ton ("GPT") of shale oil. It is uneconomical in terms of heat requirement in that a large amount of heat input is necessary to bring the mineral matrix plus kerogen up to the proper temperature in order to pyrolyze the kerogen. Accordingly, retorting oil shale that has less than 25% kerogen becomes rather costly in terms of the amount of shale oil retrieved versus the heat input. Further, the retort equipment must be quite large in order to accommodate sufficient tonnage of oil shale to produce several hundred gallons of shale oil per retort cycle. Still, the vast majority of oil shale deposits are well below the 25 GPT level.

Thus, what is needed is a technique to extract kerogen which is essentially shale free, from the oil shale rock. This would have a number of advantages. The size of the retort required to pyrolyze shale free kerogen would be decreased anywhere from 50% to 90% and losses due to the need for heating vast amounts of inert and even endothermically reactive shale would be eliminated. Another advantage would be the opportunity to flash pyrolyze the kerogen. Because of the absence of the high heat capacity rock pyrolysis could be accomplished in 1–5 minutes compared to the 30 minutes to 1 hour required by current retorting techniques. It can be expected that there will be an advantage in terms of increasing the yield of oil per unit weight kerogen in the oil shale from 70–80% of conventional retorting of unbeneficiated oil shale to 90% because secondary cracking reactions will not take place in the absence of shale rock.

(B) Upgrading of Fossil Fuels

Techniques are well known for upgrading fossil fuels particularly coal, which have a high sulfur content and high level of incombustible mineral matter (high ash). The use of fused caustic, as one technique to remove sulfur, is disclosed in the work of Robert A. Meyers, one of the co-inventors of this invention, in Chapter 8 of the book entitled: *Coal Desulfurization,* published in 1977 by Marcel Dekker Inc. of New York, N.Y. Other discussions in Meyers' book deal with the removal of both sulfur and ash by treating the coal with dilute aqueous solutions of mixed caustics under heat and pressure followed by leaching out the hydrolyzed mineral matter with dilute sulfuric acid. The term "fused Caustic" as used herein means that the caustic is in a liquid state.

The former treatments remove little of the ash while the latter utilize costly pressurized equipment. Such equipment is particularly undesirable in processing coal since the processed coal can compete only if it is sold as a relatively low cost fuel. Due to the utilization of caustic solutions in the prior art methods, the pressure equipment must be made of heavy gauge nickel which is a costly construction material, thus rendering these prior art methods uneconomical.

SUMMARY OF THE INVENTION

It is therefore a general object of the present invention to provide a novel process to produce a near pure hydrocarbon product from high mineral content sources, such as oil shale rock or coal which employs uncomplicated processing equipment, in economically advantageous, requires relatively short processing times and gives high yields.

It is another general object of this invention to provide a novel process for upgrading fossil fuels, particularly coal, which have a high sulfur content and high ash content into low sulfur, low ash content fuels which can be carried out at atmospheric pressure using uncomplicated equipment and which is economically advantageous.

It is another object of this invention to provide a novel process capable of extracting at least 80%–95% of the available kerogen from oil shale which product has been upgraded making it suitable for conversion to shale oil using much smaller size retoring equipment.

It is still another object of this invention to provide a novel two step, economical process carried out at atmospheric pressure to produce a coal product that contains less that 1% by weight sulfur and 1% by weight mineral matter.

DISCLOSURE OF INVENTION (A) Extraction of Kerogen From Oil Shale

The discovery that makes possible the attainment of the foregoing objects is that fused alkali metal caustic when mixed with crushed or broken oil shale will release the kerogen which is combined with the mineral matrix or shale rock.

The process of this invention for the extraction of kerogen carried in a mineral matrix comprises the step of dispersing the mineral matrix carrying kerogen in fused alkali metal caustic, maintaining the dispersion at a treating temperature in the range of 250° C. to 400° C. or at least five minutes whereby the kerogen is released from said mineral matrix for easy separation from the dispersion.

(B) Upgrading Fossil Fuel

The invention with respect to upgrading fossil fuels, such as coal, where both sulfur and incombustible mineral matter are to be removed, comprises mixing the fossil fuel containing substantial amounts of both sulfur and mineral matter with fused alkali metal caustic to remove more than 79% by weight of said sulfur from the fossil fuel and then washing the desulfurized fuel with an aqueous solution of a mineral acid to remove over 90% by weight of the mineral matter, said process being carried out at atmospheric pressure.

It will be appreciated that the process whereby extraction of kerogen is achieved through the use of the fused alkali metal caustic simultaneously treats the kerogen to remove the sulfur and substantial amounts of incombustible mineral matter and optionally can be washed with the mineral acid to reduce the ash content. In the circumstance where the fossil fuel is available without having to be extracted from a mineral matrix, i.e. where the sulfur and mineral matter are bound up in a continuous carbon matrix, the two step process is critical to the removal of the incombustible mineral matter to yield low ash as well as low sulfur.

DETAILED DESCRIPTION OF THE INVENTION (A) Extraction of Kerogen from Oil Shale The process of this invention works well with an oil shale mined from many different deposits. The oil shale which is to be treated by this process is mined in the usual fashion. The oil shale is prepared by passing it through conventional crushing and breaking equipment to crush the oil shale to a size of about 0.65 cm. particles. It should be pointed out that the size of the pieces of oil shale is not critical but the time of exposure to the fused caustic is a function of the size. Larger pieces take longer to extract. Good results have been obtained in the range of particle sizes from 0.25 cm. to size to 1.25 cm. and also where the average size of the pieces is 1.25 cm.

Referring to FIG. 1 of the drawings, the crushed and broken oil shale is dispersed into the reactor 12 containing fused alkali metal caustic. The alkali metal may be selected from Group IA metals of the periodic table, with the hydroxides of sodium and potassium being the preferred alkali metal caustics. The caustic materials, which are solid at ambient temperatures, are heated in the reactor 12 until reduced to the fused state.

The ratio of caustic to oil shale should be maintained at a level which will effect the most complete release of the kerogen and at the same time result in maximum desulfurization and demineralization. The useful weight ratio range is from 4–20 parts by weight caustic to one part by weight oil shale. The operable temperature at which the reactor should be maintained is 250° C. to 400° C., with the preferred range being 325° C. to 375° C. At these temperatures the organic material undergoes some oxidation and even burning, thereby reducing the hydrocarbon content. While the process can operate successfully without any control of the atmosphere in the system it has been found that the amount of oxidation can be minimized by operating a system closed to the atmosphere or, maintaining the reactor and other vessels which operate at the foregoing temperature full of the liquid to decrease the air layer or, by laying down a blanket of an inert gas such as nitrogen or argon to replace the air layer.

The dispersion is maintained in the reactor for at least five minutes. The combination of variables such as the weight ratio of the caustic to oil shale, or the size of the crushed or broken oil shale, or the temperature level within the operable range, may determine the reaction time. For example, at lower temperatures and larger pieces of oil shale it may require up to 120 minutes in the reactor. Generally it has been found that 350° C. and a dispersion ratio of 4 to 1, the kerogen is fully extracted in 5 to 10 minutes.

The extracted kerogen is in the form of a discrete mass which float to the surface of the dispersion. The shale or mineral matter either sinks to the bottom of the reactor or may be evenly distributed throughout the reactor. The kerogen is recovered from the dispersion by any one of well known skimming operations. The recovered kerogen at this stage of the process is mixed with from 2% to 60% by weight of inorganic impurities comprised of fused caustic and residual shale. It should be pointed out that typically the raw oil shale is comprised of 90% mineral matter. Thus, a significant upgrading has taken place. The sulfur content of kerogen, both organic and pyritic, is converted to a soluble form which is believed to be sodium sulphide and is in solution with the fused caustic. The mineral matter, which is associated with the kerogen, also reacts with caustic and is removed into the fused caustic. Hence, at this stage of the process there has been extracted kerogen that is suitable as a feed stock for a pyrolysis unit operation to produce shale oil.

The amount of kerogen extracted represents an 80% to 90% yield and can be as high as 95% depending on the efficiency with which the kerogen can be collected from the reactor of what was available in the raw oil shale charged into the reactor. The manner of evaluating the content of kerogen in oil shale was accomplished through a calorimetric type analysis. The calorimetric analysis gives a value in BTU, which is then used to calculate the kerogen present in the oil shale according to the following formula:

$$GPT = 1.99 + 0.01\ BTU/lb. = \text{Yield Value}$$

The kerogen which is recovered from the caustic treatment is similarly analyzed for its BTU content, to determine the yield value. The yield values indicate the quality of the material from which the shale oil is to be retrieved. Each processing step which results in an increase in the yield value of the material which forms the feed stock to the pyrolysis step significantly increases the economic advantages of the novel process.

As was mentioned earlier in this description the fused caustic treatment not only releases the kerogen bound in the shale but reacts to remove sulfur and incombustible mineral matter which significantly upgrades the kerogen. Gravimetric analysis of the kerogen at the various processing stages were conducted for sulfur and incombustible mineral content.

Continuing the reference to FIG. 1, the kerogen that is skimmed off the surface of the dispersion, identified hereinafter a kerogen-1, may go directly to the converter 14 bypassing the washer 16. At this stage, kerogen-1 has about 10–30% caustic, from 0.3% to 5% by weight sulfur, 40% to 65% by weight incombustible matter (ash), 5% to 15% kerogen and a yield value of 30–80 GPT. The alkali metal caustic will collect at the bottom of the converter 14 and be returned to the caustic regenerating unit 18.

Further upgrading of kerogen-1 can be accomplished by merely putting it through a water wash 16 to remove the caustic and the incombustible mineral matter. The kerogen-1 which has been upgraded now becomes kerogen-2. The yield value of kerogen-2 is in the range of 30–100 GPT. The sulfur and ash content of kerogen-2, on a weight to weight basis, are in the range of 0.3% to 5% and 30–60% respectively. The alkali caustic content is in the range of 1% to 5%. Kerogen content is in the range of 30% to 68.7%.

A third option is to give the kerogen-2 a dilute mineral acid wash to remove any residual caustic and react any incombustible mineral matter to further reduce the ash content. Suitable acids are sulphuric, sulphurous, and hydrochloric diluted in the range of 1% to 20% by weight. Acid treatment produces kerogen-3 which has a yield value in the range of 130 to 170 GPT, sulfur content less than 1%, and ash in the range of 1% to 15%. Double caustic treatment, kerogen-4, also reduces the ash content to a level of 1%–5%. At the conclusion of the extraction cycle the caustic/shale mixture in reactor 14 is pumped to the separator 20 where the spent shale is collected on a filter screen. The caustic filtrate goes to the regenerator 18 where $Na_2S$ is removed and it is combined with the caustic recovered from the pyrolyzer 14. The purified caustic is then ready to be recharged into the reactor.

In the circumstance the kerogen-1 is washed in the water washer 16 the wash water, which is now a dilute caustic solution, goes to the evaporator 22 to remove excess water and thence to the separator 20.

It will be appreciated that the foregoing discussion describes a process for extracting a fossil fuel and said extraction simultaneously upgrades the fossil fuel to reduce the sulfur content and the incombustible mineral matter. As will be described later in this presentation, coal, as a fossil fuel, is treated with fused caustic and dilute acids in order that it be upgraded.

The following examples are presented to illustrate the operation of the novel process and are not intended to represent the limits for defining the scope of the invention. In those examples which start with the raw oil shale the sample size was 100 grams. Each of the analyses was concerned with only ash, sulfur and organic material and therefore no attempt was made to account for 100% of the constituents.

EXAMPLE I

| Material | Oil Shale |
|---|---|
| Yield Value | Laney Medium 17 GPT |
| BTU/lb. | 1707 |
| Ash Content | 74.7% by weight |
| Sulfur Content | 1.6% by weight |
| Organic Material | 6.3% by weight |

The mined oil shale was put through a crusher and breaker and reduced to a size of about 0.65 cm. or less in the largest dimension. An amount of crushed oil shale was dispersed into sixteen times its weight of 50/50 mixture by weight of sodium hydroxide and potassium hydroxide heated to 375° C. The dispersion was imparted agitation, such as mechanical stirring. After several minutes a discrete mass began to float to the surface of the dispersion. After five minutes stirring was stopped and kerogen-1 was skimmed off, permitted to drain free of excess caustic while maintaining the heat at 350° C. and kerogen-1 was fed into the pyrolyzer 14.

The analysis of kerogen-1 was as follows:

| | |
|---|---|
| Yield Value | 31 GPT |
| BTU/lb. | 2938 |
| Ash Content | 64.7% by weight |
| Sulfur Content | 0.4% by weight |
| Caustic Content | 11% by weight |
| Organic Material Recovered | 95.0% by weight |

EXAMPLE II

In this process the kerogen-1 of Example I was given a water wash by passing it through the washer 16 to produce kerogen-2. Kerogen-2 of this example had the following analysis:

| | |
|---|---|
| Yield Value | 42 GPT |
| BTU/lb. | 3963 |
| Ash Content | 61.9% by weight |
| Sulfur Content | 0.4% by weight |
| Organic Material Recovered | 95% by weight |

EXAMPLE III

The oil shale disclosed in Example I was processed in the same manner with the exception that the time in the reactor was 82 minutes. Kerogen-1 produced by the process had the following analysis:

| | |
|---|---|
| Yield Value | 61 GPT |
| BTU/lb. | 5941 |
| Ash Content | 50.8% by weight |
| Sulfur Content | not analyzed |
| Caustic Content | 30% by weight |
| Organic Material Recovered | 95% by weight |

Kerogen-1 was then put through the water wash 16 to produce kerogen-2 which has the following analysis:

| | |
|---|---|
| Yield Value | 101 GPT |
| BTU/lb. | 9741 |
| Ash Content | 35.3% by weight |
| Sulfur Content | 0.4% by weight |
| Organic Material Recovered | 95% by weight of kerogen-1 |

EXAMPLE IV

In this example the ratio of fused caustic to oil shale was increased to 20 parts caustic per part of oil shale. In all other respects the processing conditions and steps were the same as in Example I. The analysis of the kerogen-1 and kerogen-2 were quite close to the analysis in Examples I and II.

EXAMPLE V

| | |
|---|---|
| Material | Anvil Point Oil Shale |
| Yield Value | 22 GPT |
| BTU/lb. | 2048 |
| Ash Content | 70.1% by weight |
| Sulfur Content | .7% by weight |
| Organic Material Available | 9.0% by weight |

The process of this Example was carried out in a manner similar to that of Example I with the exception that the weight ratio of caustic to oil shale was 4 to 1. The temperature of the reactor was kept at 350° C. After 30 minutes the kerogen-1 floated to the surface of the dispersion and was skimmed off. The kerogen-1 was immediately processed through the water wash 16 to produce kerogen-2 which had the following analysis:

| | |
|---|---|
| Yield Value | 78 GPT |
| BTU/lb. | 7602 |
| Ash Content | 45.9% by weight |
| Sulfur Content | 0.2% by weight |
| Organic Material Recovered | 91% by weight |

EXAMPLE VI

The process of this example followed the general steps in Example I with the exception that the reaction time was changed. The sample of oil shale was dispersed into 16 times its weight of a 50/50 mixture of sodium and potassium hydroxide maintained at 350° C. for 20 minutes. The discrete mass which floated to the surface was skimmed, permitted to drain free of excess caustic which was maintained at 350° C. and then redeposited into reactor 12 containing the fused caustic with no water wash. After 20 minutes the matter which floated to the surface was again skimmed and the material, which was a double caustic treatment kerogen, identified as kerogen-4, had the following analysis:

| | |
|---|---|
| Yield Value | 151 GPT |
| BTU/lb. | 14,992 |
| Ash Content | 8.9% by weight |
| Sulfur Content | not analyzed |
| Organic Material Recovered | 86% by weight |

EXAMPLE VII

The processing details of this example were similar to that of Example V with the exception that the kerogen-2 was given an acid wash in the acid washer 15. The analysis of kerogen-3 produced by this example was as follows:

| | |
|---|---|
| Yield Value | 155 GPT |
| BTU/lb. | 15,272 |
| Ash Content | 7.6% by weight |
| Sulfur Content | no change |
| Organic Material Extracted | 90% by weight |

EXAMPLE VIII

| | |
|---|---|
| Material | High Laney Oil Shale |
| Yield Value | 28 GPT |
| BTU/lb. | 2590 |
| Ash Content | 74.4% by weight |
| Sulfur Content | 2.2% by weight |
| Organic Material Available | 7.5% by weight |

The processing details of this example were the same as that in Example V with the exception that the raw oil shale was from a different deposit and the kerogen-1 was water washed to produce kerogen-2 which in turn was acid washed to produce kerogen-3. Analysis of kerogen-3 extracted was as follows:

| | |
|---|---|
| Yield Value | 148 GPT |
| BTU/lb. | 14,552 |
| Ash Content | 7.1% by weight |
| Sulfur Content | 0.9% by weight |
| Organic Material Extracted | 95% by weight |

EXAMPLE IX

In this example the steps were similar to Examples I and II with the exception that the temperature of the fused caustic was maintained at 250° C. for a period of 10 minutes. The analysis of kerogen-2 was as follows:

| | |
|---|---|
| Yield Value | 34 GPT |
| BTU/lb. | 3247 |
| Ash Content | 60.7% by weight |
| Sulfur Content | 0.9% by weight |
| Organic Material Recovered | 95% by weight |

EXAMPLE X

The processing details of this example were similar to those in Example II with the exception that the ratio of fused caustic to oil shale was 8 to 1, the time in the reactor was 60 minutes and after the water wash the kerogen-2 was processed through the mineral acid washer 15 to produce kerogen-3. The analysis of the extracted material was as follows:

| | |
|---|---|
| Yield Value | 165 GPT |
| BTU/lb. | 16,299 |
| Ash Content | 1.4% by weight |
| Sulfur Content | 0.5% by weight |
| Organic Material Recovered | 80.0% by weight |

The foregoing examples illustrate the manner of carrying out the process as well as provide the analysis of the kerogen as extracted. Example I shows that the raw oil shale has a yield value of 31 GPT. Of the available 6.3 weight percent kerogen in the oil shale the process recovered 95 weight percent of available kerogen. Of significance is the comparsion of the yield values of the raw oil shale and the kerogen-1 which were 17 GPT and 31 GPT respectively. The importance of this yield value will be discussed hereinafter. In terms of the alternative steps which are part of this invention the water wash of Example II increased the yield value from 31 GPT by 35 percent to 42 GPT. As described earlier the water wash removes the residual caustic plus a significant amount of mineral matter which had reacted with the caustic. While the water wash may increase the yield value it should be pointed out that it is an optional step over and above the fused caustic treatment.

Example III illustrates the effect of a longer time in the fused caustic. Examples IV and V illustrate the effect of the high ratio and low ratio of caustic to oil shale respectively. Generally, any increase over 20:1 appears to offer no significant advantage. At 4:1 the process works quite well. Example VI is a double caustic treatment with no water wash in between these steps. The double caustic treatment significantly reduces the ash content from 74.7% in the raw oil shale of Example I to 8.9% in this example. The additional step of the acid wash in Example VII to produce kerogen-3 increases the yield value (78 GPT) over kerogen-2 of Example V by 98 percent to 155 GPT. Example VIII deals with oil shale taken from another deposit. Example IX illustrates the low temperature treatment and Example X illustrates a mid-range ratio of caustic to oil shale at a reaction time of 60 minutes.

It is seen that greater than 95 percent of the available kerogen is recovered in many of the examples.

The known retort technique of extracting kerogen from oil shale is effective in recovering 70 to 80 percent of what is available. This is for the reason that the prior known retort process is carried out at 500°-600° C. to produce shale oil that is contaminated with mineral matter and inherent sulfur. The process of this invention is capable of providing the advantages of using much smaller size retorts to pyrolyze the kerogen and to significantly upgrade the oil shale and kerogen produced therefrom giving rise to greater processing economies in extracting shale oil from oil shale.

The significant increase in yield values realized from the practice of this novel process translates into all the advantages discussed earlier in the description. It will be appreciated that retorting a feed stock having a yield value of 30-80 GPT as opposed to 17 GPT or 22 GPT means that the retort can be ½ to ¼ the size. Acid treatment or double caustic also increases the yield value so that it is possible to reduce the retort size by as much as 90%.

(B) Upgrading of Fossil Fuels

This invention produces a coal product that is substantially sulfur and ash free without the utilization of pressurized equipment. In particular, the coal is produced by mixing coal containing substantial amounts of both sulfur and ash with fused alkali metal caustic at atmospheric pressure to remove greater than 79% of the sulfur from the coal and then washing the desulfurized coal with an aqueous solution of acid to remove over 90% of the coal mineral matter.

The coal product has essentially the same physical and chemical characteristics as the coal from which it is derived (feed coal) except that the coal product contains less than 1% by weight mineral matter and less than 1% by weight sulfur. It can be further distinguished from the feed coal in that the coal product has a 10% by weight higher percentage of fixed carbon, a 2% higher by weight heat content (BTU/lb), and at least a 3% by weight lower volatiles content.

Table I illustrates the characteristics of Kentucky No. 11, Illinois No. 6, and Pittsburgh No. 8 seam feed coals utilized in this process to produce new coal products.

TABLE I

| | FEED COALS | | | | |
|---|---|---|---|---|---|
| Coal | Volatiles | Fixed Carbon | Ash | Total Sulfur | BTU/lb |
| Ill. No. 6 | 39.61 | 48.43 | 11.97 | 3.53 | 12550 |
| Ky. No. 11 | 36.77 | 55.97 | 7.26 | 3.51 | 13182 |
| Pitts. No. 8 | 39.12 | 50.20 | 10.68 | 3.12 | 12907 |

The values in columns 2 through 5 are percent by weight of the weight of feed coal.

Table II illustrates the coal products obtained by subjecting the Kentucky No. 11, Illinois No. 6 and Pittsburgh No. 8 seam feed coals of Table I to the process of the present invention. The resultant products were analyzed to determine ash and sulfur content as well as the content of fixed carbon, volatiles, and heat content. The results in the "percent removal" column illustrate that the coal products of the invention have at least 79% of the sulfur and greater than 90% of the ash removed.

TABLE II

| PRODUCT COAL ANALYSIS | | | | | | | % Removal | |
|---|---|---|---|---|---|---|---|---|
| Feed Coal | Run | Vol* | FC** | Ash (dry basis) | St*** (dry basis) | (BTU/lb) | Ash | Sulfur |
| No. 6 | 1 | 28.56 | 71.07 | 0.23 | 0.30 | 13452 | 98 | 92 |
| | 2 | 28.05 | 71.36 | 0.52 | 0.42 | 13686 | 96 | 88 |
| Ky. | 3 | 28.74 | 69.68 | 0.17 | 0.53 | 13583 | 98 | 85 |
| No. 11 | 4 | 30.48 | 67.53 | 0.24 | 0.51 | 13476 | 97 | 85 |
| Pitts. | 5 | 27.33 | 72.19 | 0.44 | 0.55 | 13724 | 96 | 82 |
| No. 8 | 6 | 26.81 | 72.82 | 0.35 | 0.54 | 13879 | 97 | 83 |

*Volatiles
**Fixed Carbon
***Total Sulfur
The values shown in columns 3 through 6 are percent by weight of the weight of feed coal.

In carrying out the process for producing the coal product, feed coal is dispersed into fused alkali metal caustic. The feed coal should be less than 0.65 cm. in diameter in order to more optimally mix with the fused caustic.

Suitable fused alkali metal caustics used in the process include sodium salts or potassium salts or mixtures thereof. Specifically, the caustics are hydroxides, carbonates, formates, silicates, and acetates of sodium and potassium, or mixtures thereof. The alkali metal caustic treatment is generally carried out at a temperature in the range of from about 280° C. to about 400° C. such that the caustic will fuse and form a fused liquid with the coal dispersed therein. As mentioned earlier in the description, the degree of oxidation of the coal can be minimized by limiting the exposure of the dispersion to air. The reaction time for removing the sulfur and the noncombustible mineral matter may range from at least 5 minutes to one hour. When a microwave heat source is utilized the exposure time may be decreased to be in the range of about 1 to 5 minutes. After the coal is treated with the fused alkali caustic, the desulfurized coal will then be washed with an aqueous solution of acid at temperatures below the boiling point of the acid solution to remove as much mineral matter as possible. The aqueous solution of acid utilized may include any dilute mineral acid such as sulfuric acid, sulfurous acid, and hydrochloric acid. When sulfuric acid is used, the aqueous solution may have an acid concentration in the range of 1-20% by weight sulfuric acid.

There are additional steps that may be utilized in carrying out the invention. The coal can be washed with water prior to treating it with the acid to remove any residual sulfur compounds and to recover the alkali caustic. The coal is separated from the water caustic mixture by filtration. The caustic solution can then be put through a regenerator to be reused. Also, after the coal is treated with the acid it can be washed with water to remove any residual acid and then can be separated from the water by filtration and dried.

The process is schematically illustrated in FIG. 2. Coal particles are fed into a reactor 30 where they are mixed with caustic. The mixture is heated until the caustic forms a fused liquid with coal dispersed within it. The mixture then flows into a slurry tank 32 where it is washed with water. The mixture is separated from the water by filter 34 to remove any residual sulfur and to recover any caustic. The aqueous sulfur and caustic mixture flows into the regenerator 36 so that the caustic can be recycled into the reactor 30 during continual processing of the coal. The sulfur is removed from the system through regenerator 36. The desulfurized coal from filter 34 is fed into slurry tank 38 where it is washed with an aqueous solution of acid to remove any mineral matter in the desulfurized coal. The desulfurized and demineralized coal is then washed with water and filtered through filter 40 to recover any residual sulfuric acid. The coal product is then separated from the water in a separator 42 and dried in a dryer 44. Simultaneously, the recovered acid is recycled through regenerator 46 into the slurry tank 38 where it is reused.

EXAMPLE XI

In one series of runs, 187 grams of 45×200 mesh Western Kentucky coal (11.2% by weight ash, 3.87% by weight sulfur and having a heat content of 12258 BTU/lb.) was mixed with 750 grams of 1:1 weight mixture of potassium and sodium hydroxide pellets and heated to a temperature of 370° C. where the caustic fused to form a fused liquid with the coal dispersed in it. The mixture was maintained at the temperature for 57 minutes and then cooled and washed first with water (5 weights per weight of coal), separated by filtration, and finally dried. Each of five 20-gram portions of the dried coal then became the subject of the following Examples XII through XVI.

EXAMPLE XII

Twenty grams were washed in a 1000 ml. aqueous solution of 10% by weight sulfuric acid, followed by two 1000 ml. water washes. The coal was separated from the water by filtration and dried. It contained 0.28% by weight ash, 0.62% by weight sulfur and had a heat content of 13,482 BTU/lb. The results represent a removal of 97% of the ash and 84% of the sulfur.

EXAMPLE XIII

Twenty grams were washed in a 1000 ml. aqueous solution of 5% by weight sulfuric acid, followed by two 1000 ml. water washes. The coal was separated from the water by filtration and dried. It contained 0.26% by weight ash, 0.71% by weight sulfur and had a heat content of 13,516 BTU/lb. 98% of the ash and 82% of the sulfur were removed.

EXAMPLE XIV

Twenty grams were washed in a 1000 ml. aqueous solution of 2% by weight sulfuric acid, followed by two 1000 ml. water washes. The coal was separated from the water by filtration and dried. It contained 0.59% by weight ash, 0.63% by weight sulfur, and had a heat content of 13,390 BTU/lb. 95% of the ash and 84% of the sulfur were removed.

EXAMPLE XV

Twenty grams were washed in a 1000 ml. aqueous solution of 1% by weight sulfuric acid, followed by two 1000 ml. water washes. The coal was separated from the water by filtration and dried. It contained 0.43% by weight ash, 0.58% by weight sulfur, and had a heat content of 13,512 BTU/lb. 96% of the ash and 85% of the sulfur were removed.

EXAMPLE XVI

Twenty grams were washed in two 1000 ml. water washes only (no acid wash). The coal contained 8.8% by weight ash, 0.59% by weight sulfur and had a heat content of 12,555 BTU/lb. This represents a removal of only 21% of the ash and 85% of the sulfur.

In Example XIII the feed coal is treated with fused caustic only and is not followed by an acid wash. This example illustrates that when the caustic alone is used there is low ash removal. When acid is used alone (as illustrated in the prior art) there is also minimal ash removal. Thus, the combination of caustic and acid is necessary for removal of 79% of the sulfur and 90% of the ash from the feed coal. The precise mechanism by which the sequential treatment of the coal with fused caustic and dilute mineral acid is not fully understood. It is believed that the caustic reacts with the mineral matter to produce an intermediate alkali metal salt which has a high dissociation constant rendering it more reactable with acid.

The coal produced by the novel process of this invention has the physical property, unlike heretofore known coals with similarly low ash and low sulfur content, of remaining solid at higher temperatures when other coals turn liquid, that is, have a pour point. Heretofore known techniques for reducing the content of ash and sulfur below 1% by weight of the coal required hydrogenating the coal through the solvent extraction of coal. Since the coal of this invention has not been hydrocracked it has no pour point. Because of this significant difference in the physical properties of this coal versus other low ash, low sulfur content coals it represents a new coal product.

Figure 1:
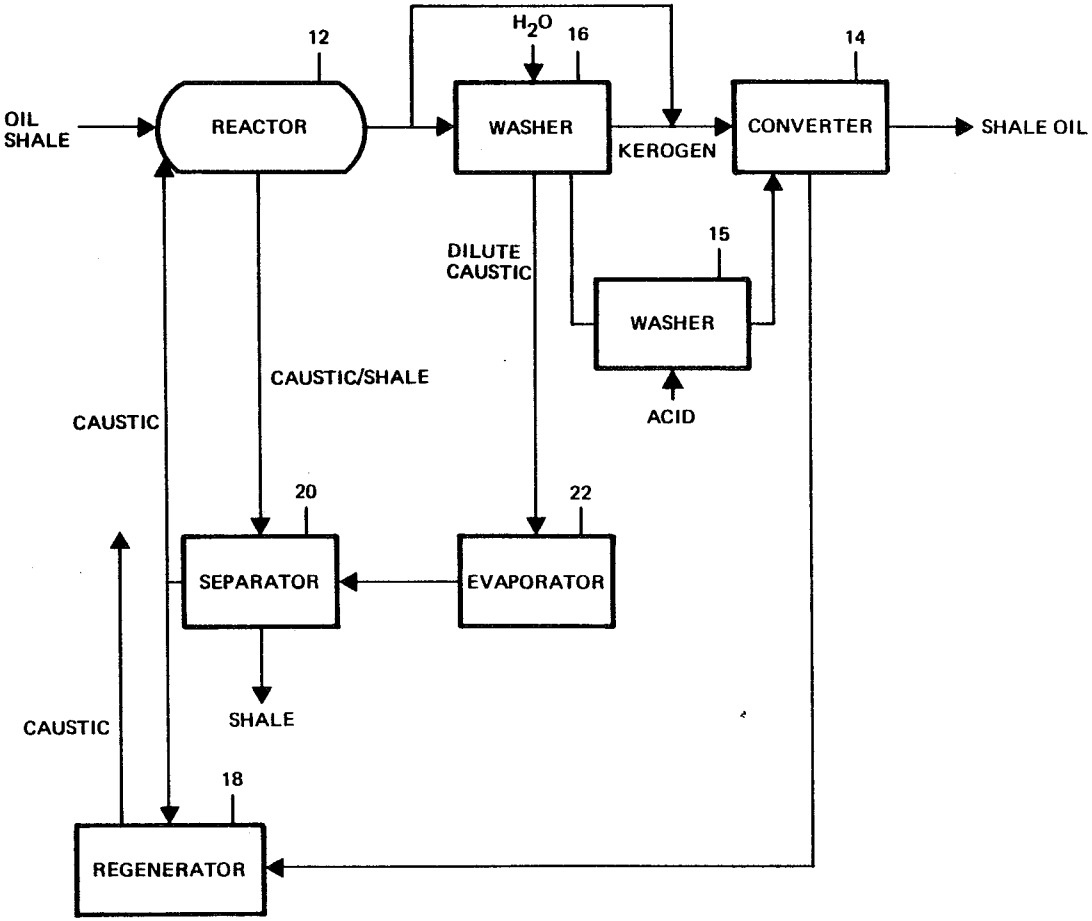
FIG. 1 is a schematic illustrating the unit processes for carrying out the extraction of shale oil from oil shale.
Figure 2:
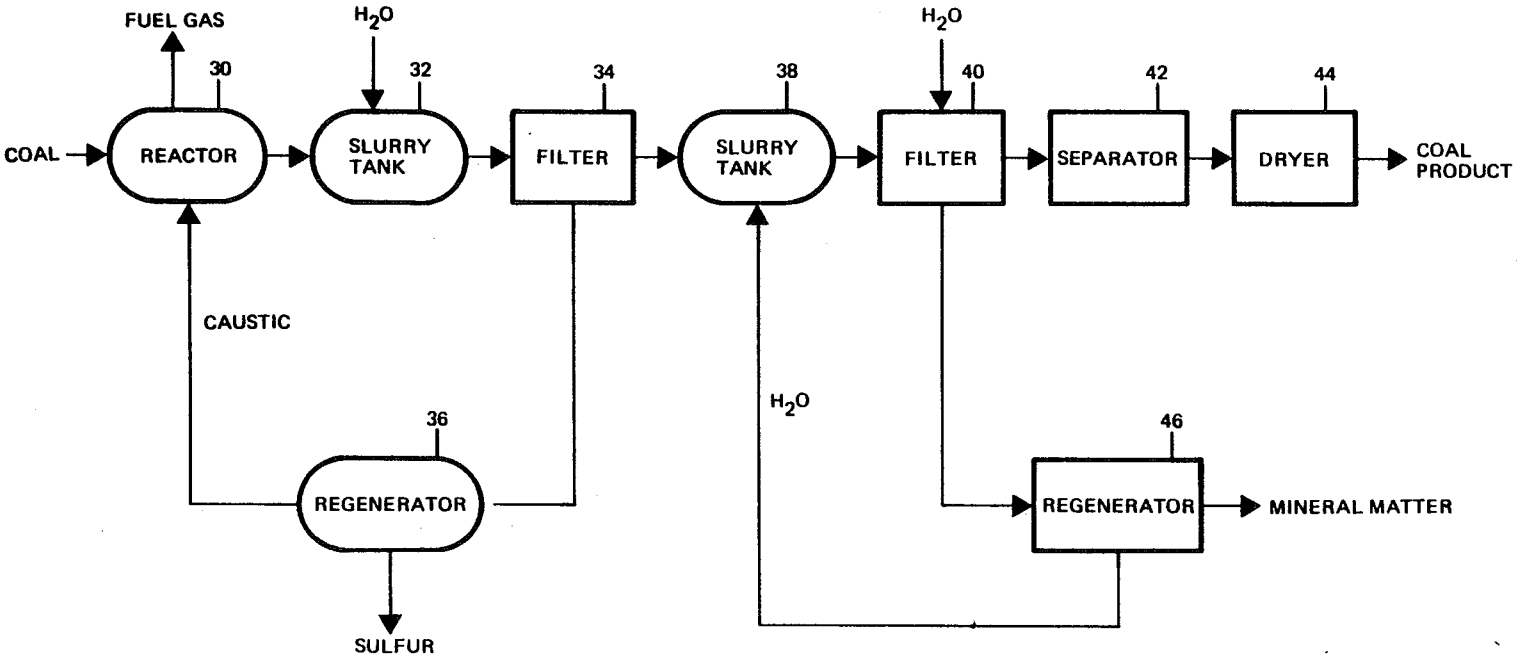
FIG. 2 is a schematic illustrating the unit processes for the two step process of producing low sulfur, low ash fossil fuels.

We claim:

1. A process for the extraction of kerogen from oil shale comprising the steps of:

dispersing one part by weight of the oil shale in at least four parts by weight fused alkali metal caustic, (b) maintaining the dispersion at a treating temperature in the range of about 250° C. to about 400° C. for at least five minutes, whereby kerogen is released from said oil shale for easy separation from the dispersion, (c) separating the released kerogen from the dispersion, and (d) washing mineral matter from the separated kerogen with water.

2. The process as set forth in claim 1 wherein the kerogen upon release from the oil shale floats to the surface of the dispersion.

3. The process of claim 1 in which the sulfur content of the oil shale is greater than 1% by weight, and the sulfur content of the water-washed kerogen is less than about 0.5% by weight.

4. The process of claim 1 in which the separated kerogen contains less than 1% by weight sulfur.

5. The process of claim 1 carried out essentially at atmospheric pressure.

6. The process of claim 1 in which the separated kerogen contains less than 65% by weight ash.

7. The process of claim 6 in which the separated kerogen conains less than 1% by weight sulfur.

8. A process for the extraction of kerogen from oil shale, the oil shale containing at least about 1% by weight sulfur, the method comprising the steps of:

(a) dispersing 1 part by weight of said oil shale into 4 to 20 parts by weight of fused alkali metal caustic, (b) maintaining the dispersion at a treating temperature in the range of about 250° C. to about 400° C. under an inert atmosphere for a period in the range of about 5 minutes to about 80 minutes at essentially atmospheric pressure, whereby the kerogen is released from said oil shale for easy separation from said dispersion, (c) separating the released kerogen from the dispersion, (d) washing the released kerogen with water, and (e) washing the water-washed released kerogen with an aqueous solution of acid to form acid washed kerogen containing less than about 15% by weight ash and less than about 0.5% by weight sulfur and having a yield value greater than 130 gallons per ton.

9. The process set forth in claim 8 wherein said alkali metal caustic is selected from the group consisting of sodium hydroxide potassium hydroxide, and mixtures thereof.

10. The process set forth in claim 8 wherein the treating temperature is from about 325° C. to about 375° C.

11. The process set forth in claim 1 or claim 8 wherein the separated kerogen is contacted with fused caustic for a period of time equal to at least five minutes.

12. The process set forth in claim 1 or claim 9 wherein the fused caustic is a 50/50 mixture of sodium and potassium hydroxide.

13. The process of claim 1 or 8 in which the step of dispersing comprises dispersing the oil shale carrying kerogen in a solution comprising fused alkali metal caustic and essentially no organic material.

14. The process of claim 13 in which the solution consists essentially of fused alkali metal caustic and salts thereof.

15. The process of claim 1 or 8 where the steps of dispersing and maintaining occur under an inert atmosphere.

16. A process for the extraction of kerogen from oil shale comprising the steps of:

(a) dispersing one part by weight of the oil shale in at least four parts by weight fused alkali metal caustic, (b) maintaining the dispersion at a treating temperature in the range of about 250° C. to about 400° C. under an inert atmosphere for at least five minutes, whereby the kerogen is released from said oil shale for easy separation from the dispersion, (c) separating the released kerogen from the dispersion, (d) washing mineral matter from the separated kerogen with water, and (e) washing the water-washed separated kerogen with a dilute solution of mineral acid.

17. The process set forth in claim 8 or 15 wherein the acid is selected from the group consisting of sulfuric, sulfurous and hydrochloric acid.

18. The process set forth in claim 17 wherein the concentration of acid in aqueous solution is from about 1% to about 20% by weight.

19. The process of claim 9 in which the acid-washed kerogen has a yield value of greater than 130 gallons per ton.

20. A process for the extraction of kerogen from oil shale comprising the steps of:

(a) dispersing 1 part by weight of the oil shale in at least 4 parts by weight fused alkali metal caustic;

(b) maintaining the dispersion at a temperature of from about 250° C. to about 400° C. for about 5 minutes to about 80 minutes, whereby kerogen is released from the oil shale;

(c) separating the released kerogen from the dispersion, the separated kerogen containing ash;

(d) dispersing the separated kerogen in fused alkali metal caustic, and maintaining the dispersion at a temperature of from about 250° C. to about 400° C. for at least 5 minutes, whereby the ash content of the kerogen is reduced; and (e) separating the kerogen of reduced ash content from the dispersion, the separated kerogen of reduced ash content having an ash content of less than 5% by weight.

21. The process of claim 20 in which the step of dispersing the separated kerogen in fused alkali metal caustic comprises dispersing the separated kerogen in fused alkali metal caustic with the weight ratio of fused alkali metal caustic to separated kerogen being at least 4:1.

22. The process of claim 20 in which both steps of maintaining the dispersion comprise maintaining the dispersion under an inert atmosphere.

* * * * *